US005255522A

United States Patent [19]

Agrawal et al.

[11] Patent Number: 5,255,522

[45] Date of Patent: Oct. 26, 1993

[54] VAPORIZATION OF LIQUID OXYGEN FOR INCREASED ARGON RECOVERY

[75] Inventors: Rakesh Agrawal, Allentown; Terrence F. Yee, Macungie, both of Pa.

[73] Assignee: Air Products and Chemicals, Inc., Allentown, Pa.

[21] Appl. No.: 835,642

[22] Filed: Feb. 13, 1992

[51] Int. Cl.[5] ..... F25J 3/04

[52] U.S. Cl. ..... 62/22; 62/24; 62/40

[58] Field of Search ..... 62/22, 24, 40; 60/39.12

[56] References Cited

U.S. PATENT DOCUMENTS

| | | | |
|---|---|---|---|
| 4,670,031 | 6/1987 | Erickson et al. | 62/22 |
| 4,756,731 | 7/1988 | Erickson | 62/22 |
| 4,822,395 | 4/1989 | Cheung | 62/22 |
| 4,932,212 | 6/1990 | Rohde | 62/22 |
| 5,034,043 | 7/1991 | Rottmann | 62/22 |
| 5,076,823 | 12/1991 | Hansel et al. | 62/22 |
| 5,081,845 | 1/1992 | Allam et al. | 62/24 |

OTHER PUBLICATIONS

R. E. Latimer, Distillation of Air, Feb. 1967, pp. 35-59.

*Primary Examiner*—Ronald C. Capossela

*Attorney, Agent, or Firm*—Robert J. Wolff; James C. Simmons; William F. Marsh

[57] ABSTRACT

The present invention relates to an improvement for the production of argon from cyrogenic air separation processes. In particular, the improvement comprises satisfying a portion of the crude argon column condensing duty with refrigeration provided from the vaporization of a portion of the liquid oxygen from the bottom of the low pressure column.

13 Claims, 8 Drawing Sheets

VAPORIZATION OF LIQUID OXYGEN FOR INCREASED ARGON RECOVERY

FIELD OF THE INVENTION

The present invention is related to a process for the cryogenic distillation of air using a multiple column distillation system to produce argon, in addition to nitrogen and/or oxygen.

BACKGROUND OF THE INVENTION

Argon is a highly inert element over a very wide range of conditions, both at cryogenic and very high temperatures. It is used in steel-making, light bulbs, electronics, welding and gas chromatography. The major source of argon is that found in the air and it is typically produced therefrom using cryogenic air separation units. The world demand for argon is increasing and thus it is essential to develop an efficient process which can produce argon at high recoveries using cryogenic air separation units.

The most significant increase in argon production can be realized for cases where the air separation unit is operated at an elevated pressure (i.e., a feed air pressure greater than 100 psia). Using the conventional air separation schemes at the higher pressures, the argon recovery becomes very low since the argon/oxygen separation becomes more difficult at higher pressures. The focus of the present invention is for the recovery of argon at elevated pressures.

Historically, the typical cryogenic air separation unit used a double distillation column with a crude argon (or argon side arm) column to recover argon from air. A good example of this typical unit is disclosed in an article by Latimer, R. E., entitled "Distillation of Air", in Chemical Engineering Progress, 63 (2), 35–59 [1967]. A conventional unit of this type is shown in FIG. 1, which is discussed later in this disclosure.

However, this conventional process has some shortcomings. U.S. Pat. No. 4,670,031 discusses in detail these shortcomings and explains the problems which limit the amount of crude argon recovery with the above configuration. This can be easily explained with reference to FIG. 1. For a given production of oxygen and nitrogen products, the total boilup and hence the vapor flow in the bottom of section I of the low pressure column is nearly fixed. As this vapor travels up the low pressure column it is split between the feed to the crude argon column and the feed to the bottom of section II of the low pressure column. The gaseous feed to the top of section II of the low pressure column is derived by the near total vaporization of a portion of the crude liquid oxygen stream in the boiler/condenser located at the top of the crude argon column. The composition of this gaseous feed stream is typically 35–40% oxygen. A minimum amount of vapor is needed in section II of the low pressure column, namely the amount necessary for it to reach the introduction point of the gaseous feed to the top of section II without pinching in this section. Since the composition of the gaseous feed stream to the top of section II is essentially fixed, the maximum flow of vapor which can be sent to the crude argon column is also limited. This limits the argon which can be recovered from this process.

In order to increase argon recovery, it is desirable to increase the flow of vapor to the crude argon column. This implies that the vapor flow through section II of the low pressure column must be decreased (as total vapor flow from the bottom of the low pressure column is nearly fixed). One way to accomplish this would be to increase the oxygen content of the gaseous feed stream to the top of section II of the low pressure column because that would decrease the vapor flow requirement through this section of the low pressure column. However, since this gaseous feed stream is derived from the crude liquid oxygen, its composition is fixed within a narrow range as described above. Therefore, the suggested solution is not possible with the current designs and the argon recovery is thus limited.

Recently, elevated pressure (EP) cycles have been proposed for air separation plants. In the EP cycles, the supply pressure of air to the cold box is higher than the conventional pressures of 80–95 psia. Typically, these pressures are higher than 100 psia. One key advantage is that at a higher pressure, smaller equipment is required due to the smaller volume of flow. In addition, significant power savings can be realized when high pressure products are desired. By operating the air separation unit at an elevated pressure, the pressure of streams sent to the product compressors also increases. This reduces the pressure ratio across the product compressors which translates to significant power savings. This power reduction more than offsets the additional power required to compress the column air to the elevated pressure. A key disadvantage of operating the air separation unit at an elevated pressure, however, is that the argon recovery is usually very low. This is due to the difficulty of the $Ar/O_2$ separation at the higher pressures.

To increase the argon recovery for the EP cycle, U.S. Pat. No. 5,034,043 suggests operating the crude argon column at a lower pressure than the one dictated by the feed from the low pressure column. The rationale is that by operating at the lower pressure, the separation of argon and oxygen becomes less difficult and hence, more argon can be recovered. The scheme involves expanding the crude argon column feed from the low pressure column prior to the crude argon column. The separation is then done at a reduced pressure. The bottom stream from the crude argon column is then boosted in pressure by a pump and returned to the low pressure column. The disadvantage of this method is that the amount of feed to the crude argon column is still limited. Furthermore, the difficulty of the $Ar/O_2$ separation still exists in the low pressure column which also restricts the concentration of argon in the feed sent to the crude argon column. Overall, the amount of argon recovery is still very limited. Another deficiency of this scheme is that crude liquid oxygen from the bottom of the high pressure column which is vaporized at the top of the crude argon column is at a pressure lower than the low pressure column. Therefore, this vaporized stream is warmed, boosted and recycled to the low pressure column. This adds another booster compressor and adds recycle losses. The recycle flow is a substantially large fraction of the feed air.

U.S. Pat. No. 4,822,395 teaches another method of argon recovery. In this method all the crude liquid oxygen from the bottom of the high pressure column is fed to the low pressure column. Instead of drawing all the oxygen product as gaseous oxygen from the low pressure column, nearly all the oxygen product is withdrawn as liquid oxygen from the bottom of the low pressure column, reduced in pressure and boiled in the boiler/condenser located at the top of the crude argon column. The crude argon column overhead vapor is condensed in this boiler/condenser and provides reflux to this column. It should be noted in this patent that all the condensing duty for the reflux at the top of the crude argon column is provided by vaporizing liquid oxygen from the bottom of the low pressure column. There are some disadvantages to this method also. The liquid from the bottom of the low pressure column is nearly pure oxygen. Since it condenses the crude argon overhead vapor, its pressure when boiled will be much lower than the low pressure column pressure. This means that nearly all of the oxygen gas recovered will be at a pressure which is significantly lower than that of the low pressure column. When oxygen is a desired product, this leads to a higher energy consumption due to the lower suction pressure at the oxygen product compressor. Another drawback of the suggested solution is that since crude argon overhead is condensed against pure oxygen, the amount of vapor which can be fed to the crude argon column is limited by the amount of oxygen present in the air. Consequently, even though the vapor flow is increased in the bottom section of the low pressure column by not drawing any gaseous oxygen, the feed to the crude argon column still has to be quite low. The recovery of argon is therefore severely limited.

Finally, another process teaching a method to improve argon recovery is taught in U.S. Pat. No. 5,114,449. This prior art process is shown in FIG. 2 which is also discussed later in this disclosure. In this process, all the crude liquid $O_2$ from the bottom of the high pressure column is fed to the low pressure column. The vapor at the top of the crude argon column is now condensed by heat exchange with a liquid stream in the low pressure column. This heat exchange place is located between the crude liquid oxygen feed location and the withdrawal point of the argon-rich vapor stream which is the feed stream for the crude argon column. This thermal linkage between the crude argon and the low pressure columns leads to enhanced argon recovery when compared to the process shown in FIG. 1 and the one taught in U.S. Pat. No. 4,670,031. However, in certain instances, this enhanced argon recovery is still not sufficient to meet the increased demand of argon and it is desirable to envision methods which would further increase the argon recovery.

Clearly then, there is a need for a process which does not have the above-mentioned limitations and can produce argon with greater recoveries.

SUMMARY OF THE INVENTION

The present invention is an improvement to a cryogenic air distillation process producing argon using a multiple column distillation system comprising a high pressure column, a low pressure column and a crude argon column wherein a liquid oxygen bottoms is produced in the low pressure column and wherein the crude argon column has a condensing duty. The improvement is for increasing the argon recovery of the process and comprises satisfying a first portion only of the crude argon column condensing duty with refrigeration provided from the vaporization of a portion of the liquid oxygen bottoms at reduced pressure. The remaining portion of the crude argon column condensing duty in the present invention is satisfied with existing refrigeration methods known in the art. The specific steps for satisfying the first portion of the crude argon condensing duty comprise the following:

(a) removing a portion of the liquid oxygen bottoms from the bottom of the low pressure column;

(b) reducing the pressure of the portion of the liquid oxygen bottoms; and (c) vaporizing the portion of the liquid oxygen bottoms by heat exchange against a portion of the argon-rich vapor overhead wherein an adequate temperature difference exists between the argon-rich vapor overhead and the portion of the vaporizing liquid oxygen bottoms, thereby condensing said portion of the argon-rich vapor overhead and returning at the condensed argon to the top of the crude argon column to provide a portion of the liquid reflux for the crude argon column.

DETAILED DESCRIPTION OF THE INVENTION

Figure 1:
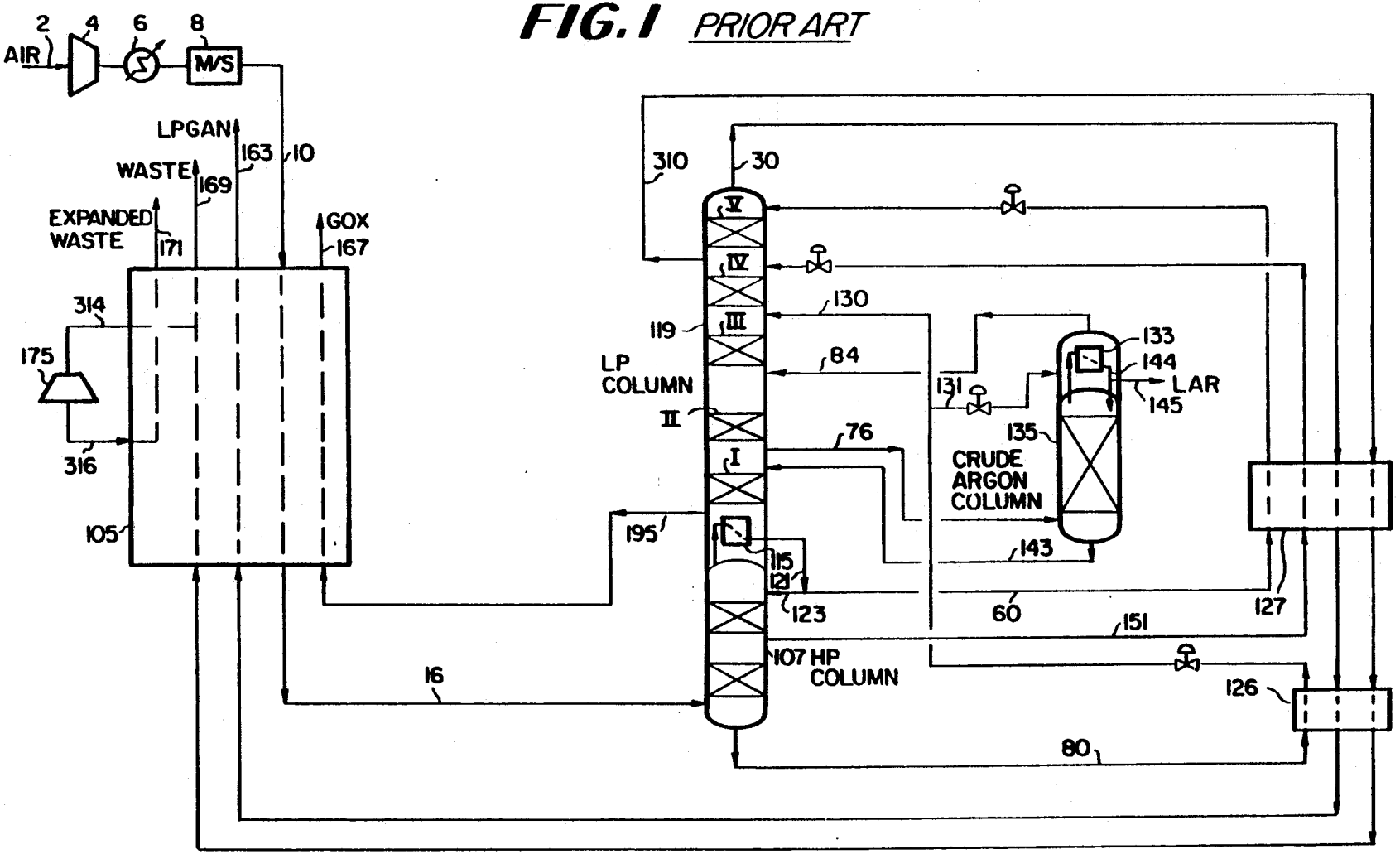
FIG. 1 PRIOR ART
FIG. 1 is a schematic diagram of a typical cryogenic air separation process producing argon as found in the prior art.

To better understand the present invention, it is important to understand the background art. As an example, a typical process for the cryogenic separation of air to produce nitrogen, oxygen and argon products using a three column system is illustrated in FIG. 1. With reference to FIG. 1, a feed air stream 2 is pressurized in compressor 4, cooled against cooling water in heat exchanger 6, and cleaned of impurities that will freeze out at cryogenic temperatures in mole sieves 8. This clean, pressurized air stream 10 is then cooled in heat exchanger 105 and fed via line 16 to high pressure column 107 wherein it is rectified into a nitrogen-rich overhead and a crude liquid oxygen bottoms. The nitrogen-rich overhead is condensed in reboiler/condenser 115, which is located in the bottoms liquid sump of low pressure column 119, and removed from reboiler/condenser 115 via line 121 and further split into two parts. The first part is returned to the top of high pressure column 107 via line 123 to provide reflux; the second part, in line 60, is subcooled in heat exchanger 127, reduced in pressure and fed to top of low pressure column 119 as reflux. The crude liquid oxygen bottoms from high pressure column 107 is removed via line 80, subcooled in heat exchanger 126, reduced in pressure and split into two portions, lines 130 and 131 respectively. The first portion in line 130 is fed to an upper intermediate location of low pressure column 119 as crude liquid oxygen reflux for fractionation. The second portion in line 131 is further reduced in pressure and heat exchanged against the overhead from crude argon column 135 wherein it is vaporized and subsequently fed via line 84 to an intermediate location of low pressure column 119 for fractionation. A side stream containing argon and oxygen is removed from a lower intermediate location of low pressure column 119 and fed via line 76 to crude argon column 135 for rectification into a crude argon overhead stream and bottoms liquid which is recycled via line 143 back to low pressure column 119. The crude argon column overhead is fed to boiler/condenser 133 where it is condensed against the second portion of the subcooled crude liquid oxygen bottoms in line 131. The condensed crude argon is then returned to crude argon column 135 via line 144 to provide reflux. A portion of line 144 is removed as the crude liquid argon product via line 145. Also as a feed to low pressure column 119, a side stream is removed from an intermediate location of high pressure column 107 via line 151, cooled in heat exchanger 127, reduced in pressure and fed to an upper location of low pressure column 119 as added reflux. To complete the cycle, a low pressure nitrogen-rich overhead is removed via line 30 from the top of low pressure column 119, warmed to recover refrigeration in heat exchangers 127, 126 and 105, and removed from the process as the low pressure nitrogen product via line 163. An oxygen enriched vapor stream is removed via line 195 from the vapor space in low pressure column 119 above reboiler/condenser 115, warmed in heat exchanger 105 to recover refrigeration and removed from the process via line 167 as the gaseous oxygen product. Finally, an upper vapor stream is removed from low pressure column 119 via line 310, warmed to recover refrigeration in heat exchangers 127, 126 and 105 and then vented from the process as waste in line 169. To provide refrigeration, a portion of line 310 is removed from heat exchanger 105 via line 314, expanded in expander 175 and returned to heat exchanger 105 via line 316 prior to being vented from the process as expanded waste in line 171.

Figure 2:
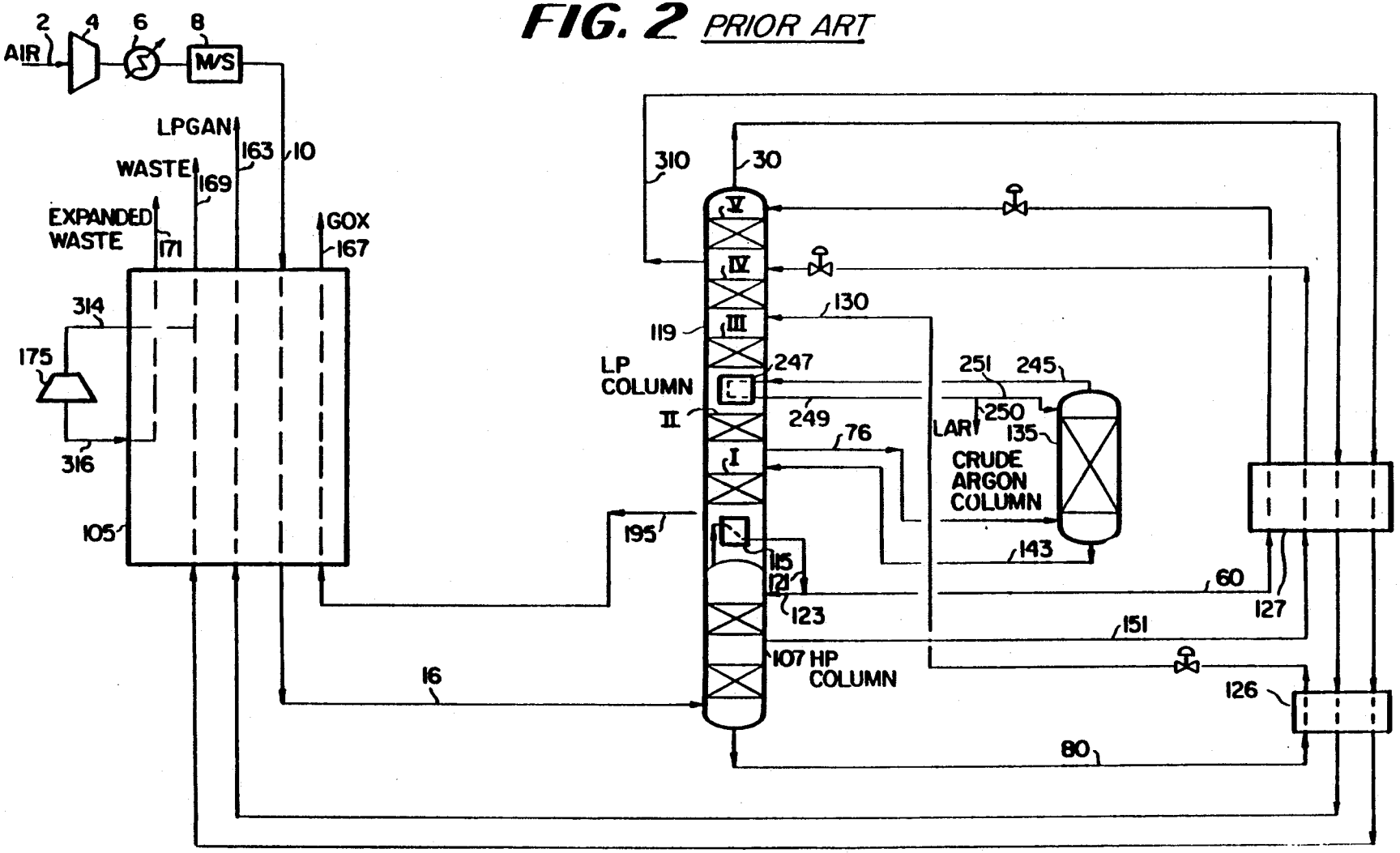
FIG. 2 PRIOR ART
FIG. 2 is a schematic diagram of a second embodiment of a typical cryogenic air separation process producing argon as found in the prior art.

The prior art process shown in FIG. 2 is the same as the prior art process shown in FIG. 1 (similar features of the FIG. 2 process utilize common numbering with FIG. 1) except it incorporates the invention disclosed in U.S. Pat. No. 5,114,449. The invention disclosed in U.S. Pat. No. 5,114,449 teaches a better method of thermally linking the top of the crude argon column with the low pressure column, thereby producing argon at higher recoveries vis-a-vis FIG. 1's process. Referring now to FIG. 2, the entire crude liquid oxygen stream 80 is fed to a suitable location in the low pressure column via line 130. Unlike FIG. 1, no portion of the crude liquid oxygen stream 80 is boiled against the crude argon column overhead. Instead, liquid descending low pressure column 119 (selected from a location between the feed point of the crude liquid oxygen stream 80 and the removal point for the argon containing gaseous side stream 76) is boiled against the crude argon column overhead. The crude argon column overhead is removed as an argon-rich vapor overhead in line 245 and fed to boiler/condenser 247 which is located in low pressure column 119 between sections II and III. Herein the argon-rich vapor overhead is condensed in indirect heat exchange against the intermediate liquid descending low pressure column 119. The condensed, argon-rich liquid is removed from boiler/condenser 247 via line 249 and split into two portions. The first portion is fed to the top of crude argon column 135 via line 251 to provide reflux for the column. The second portion is removed from the process via line 250 as crude liquid argon product.

The current invention suggests an improvement for enhanced argon recovery in a system which uses a high pressure column, a low pressure column and a crude argon column wherein a liquid oxygen bottoms is produced in the low pressure column and wherein the crude argon column has a condensing duty. The processes depicted in FIGS. 1 and 2 which are described above are both representative of such a system. The improvement comprises satisfying a first portion only of the crude argon column condensing duty with refrigeration provided from the vaporization of a portion of the liquid oxygen bottoms at reduced pressure. The remaining portion of the crude argon column condensing duty in the present invention is satisfied with existing refrigeration methods known in the art. The specific steps for satisfying the first portion of the crude argon condensing duty comprise the following:

(a) removing a portion of the liquid oxygen bottoms from the bottom of the low pressure column;

(b) reducing the pressure of the portion of the liquid oxygen bottoms; and (c) vaporizing the portion of the liquid oxygen bottoms by heat exchange against a portion of the argon-rich vapor overhead wherein an adequate temperature difference exists between the argon-rich vapor overhead and the portion of the vaporizing liquid oxygen bottoms, thereby condensing said portion of the argon-rich vapor overhead and returning the condensed argon to the top of the crude argon column to provide a portion of the liquid reflux for the crude argon column.

The present invention effects a higher argon recovery by allowing optimization of the amount of feed to be sent to the crude argon column. Unlike U.S. Pat. No. 4,822,395 where the entire condensing duty for the crude argon column is satisfied by vaporizing liquid oxygen bottoms from the bottom of the low pressure column, the present invention satisfies only a portion of the condensing duty for the crude argon column in this manner. The remaining portion of the crude argon column condensing duty in the present invention is satisfied by existing refrigeration methods known in the art. (These existing methods include, but are not limited to, thermally linking the top of the crude argon column with the low pressure column as shown in the prior art process of FIG. 2 or vaporizing crude liquid oxygen from the bottom of the high pressure column as shown in the prior art process of FIG. 1.). By providing such flexibility in satisfying the crude argon column condensing duty, the present invention allows optimization of the amount of feed to be sent to the crude argon column. As compared to U.S. Pat. No. 4,822,395, this added flexibility means that the crude argon column condensing duty, and hence the crude argon column feed rate, is no longer limited by the quantity of liquid oxygen bottoms available in the bottom of the low pressure column. This allows more feed to be sent to the crude argon column as compared to U.S. Pat. No. 4,822,395 which in turn effects a higher argon recovery as compared to U.S. Pat. No. 4,822,395.

Figure 3:
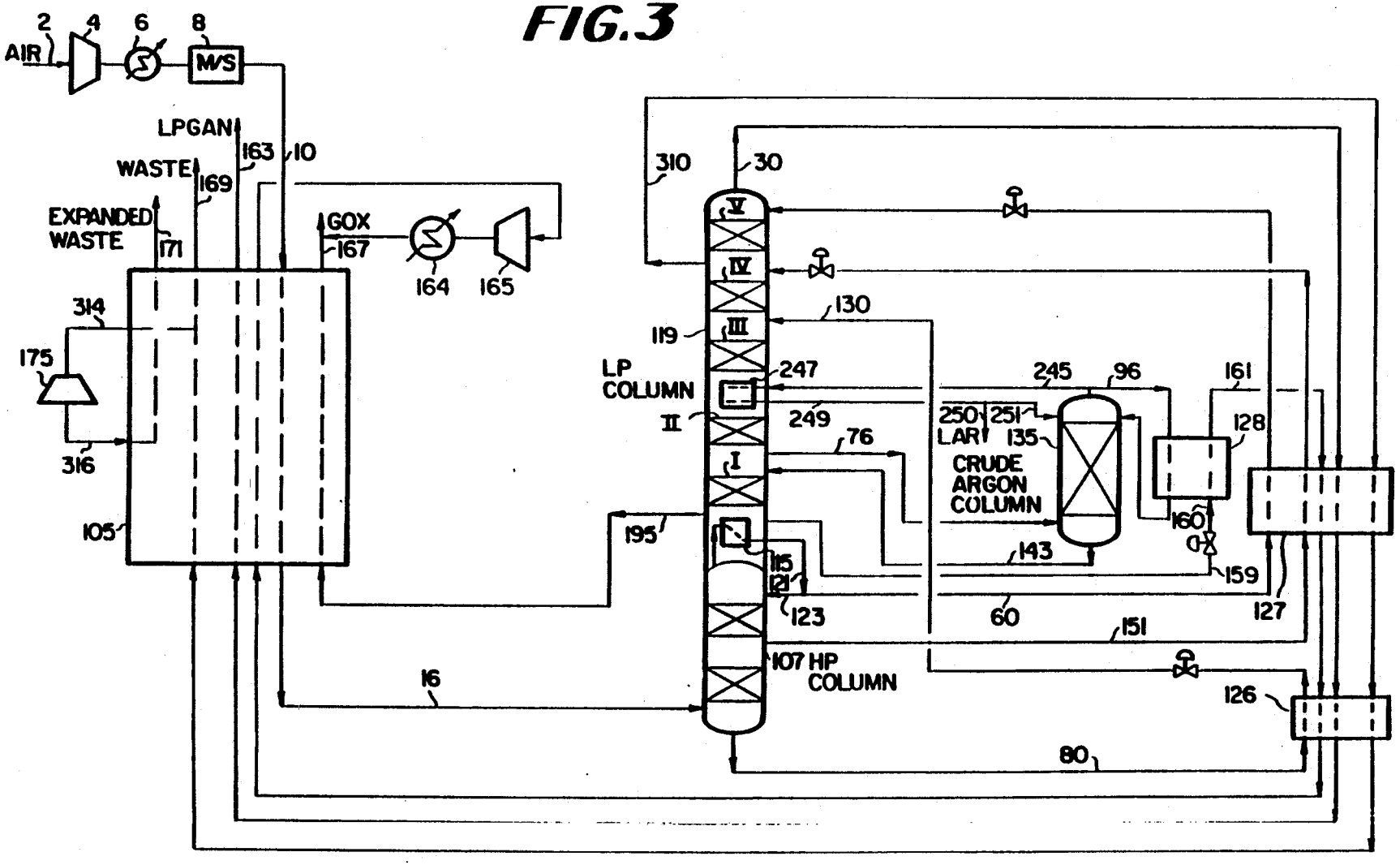
FIG. 3 is a schematic diagram of a first embodiment of the process of the present invention.

The process of the present invention will now be illustrated with reference to the process flow diagram of FIG. 3. Except for incorporation of the present invention, the process shown in FIG. 3 is identical to the prior art process shown in FIG. 2 (similar features of the FIG. 3 process utilize common numbering with FIG. 2). In FIG. 2, the entire gaseous oxygen production requirement is drawn from the low pressure column via stream 195. In FIG. 3, only a portion of the gaseous oxygen production requirement is drawn from the low pressure column via stream 195. The difference is made up by drawing additional oxygen (as liquid) from the bottom of the low pressure column via stream 159. The additional amount of liquid oxygen is reduced in pressure from stream 159 to 160 and vaporized against a condensing portion of the crude argon column overhead (stream 96). The pressure of stream 160 is determined by the temperature at which the crude argon column overhead will condense while accounting for a proper approach temperature in boiler/condenser 128. The vaporized oxygen stream 161 is then warmed in subcoolers 127 and 126 and main exchanger 105, compressed in compressor 165, cooled against cooling water in cooler 164 and then combined with stream 167 for the total gaseous oxygen product stream. (Optionally, vaporized oxygen stream 161 need not be compressed or combined with stream 167, thereby resulting in a separate oxygen product stream at a lower pressure.) The condensed crude argon overhead is fed back to the crude argon column as additional reflux. It is important to note in FIG. 3 that, unlike U.S. Pat. No. 4,822,395 where the entire condensing duty for the crude argon column is satisfied by vaporizing liquid oxygen bottoms from the bottom of the low pressure column, FIG. 3 satisfies only a portion of the condensing duty for the crude argon column in this fashion. With reference to FIG. 3, the boiling of liquid oxygen stream 159 to gaseous oxygen stream 161 in boiler/condenser 128 satisfies only a portion of the condensing duty of the crude argon column. In FIG. 3, the remaining condensing duty of the crude argon column is provided by thermally linking the top of the crude argon column with the low pressure column as disclosed in U.S. Pat. No. 5,114,449. It should be noted, however, that the present invention does not limit satisfaction of the remaining condensing duty to the method disclosed in U.S. Pat. No. 5,114,449. For example, the remaining condensing duty can also be satisfied by vaporizing crude liquid oxygen from the bottom of the high pressure column as shown in the prior art process of FIG. 1.

The present invention can be used with any distillation configuration producing argon, but preferentially a distillation configuration producing argon by elevated pressure air separation. The higher the pressure of the air, the greater is the benefit that will be realized by the present invention. The preference for an elevated pressure exists so that when the liquid oxygen stream is reduced to a pressure determined by the temperature at which the crude argon column overhead will condense (while accounting for a proper approach temperature in boiler/condenser 128), the pressure does not become intolerably low. However, it should be emphasized that even though an elevated pressure is preferred, it is not necessary. For example, the pressure of the liquid oxygen stream could be reduced to a subatmospheric pressure. In such a case, compressor 165 in FIG. 3 will have to be a vacuum pump.

Figure 4:
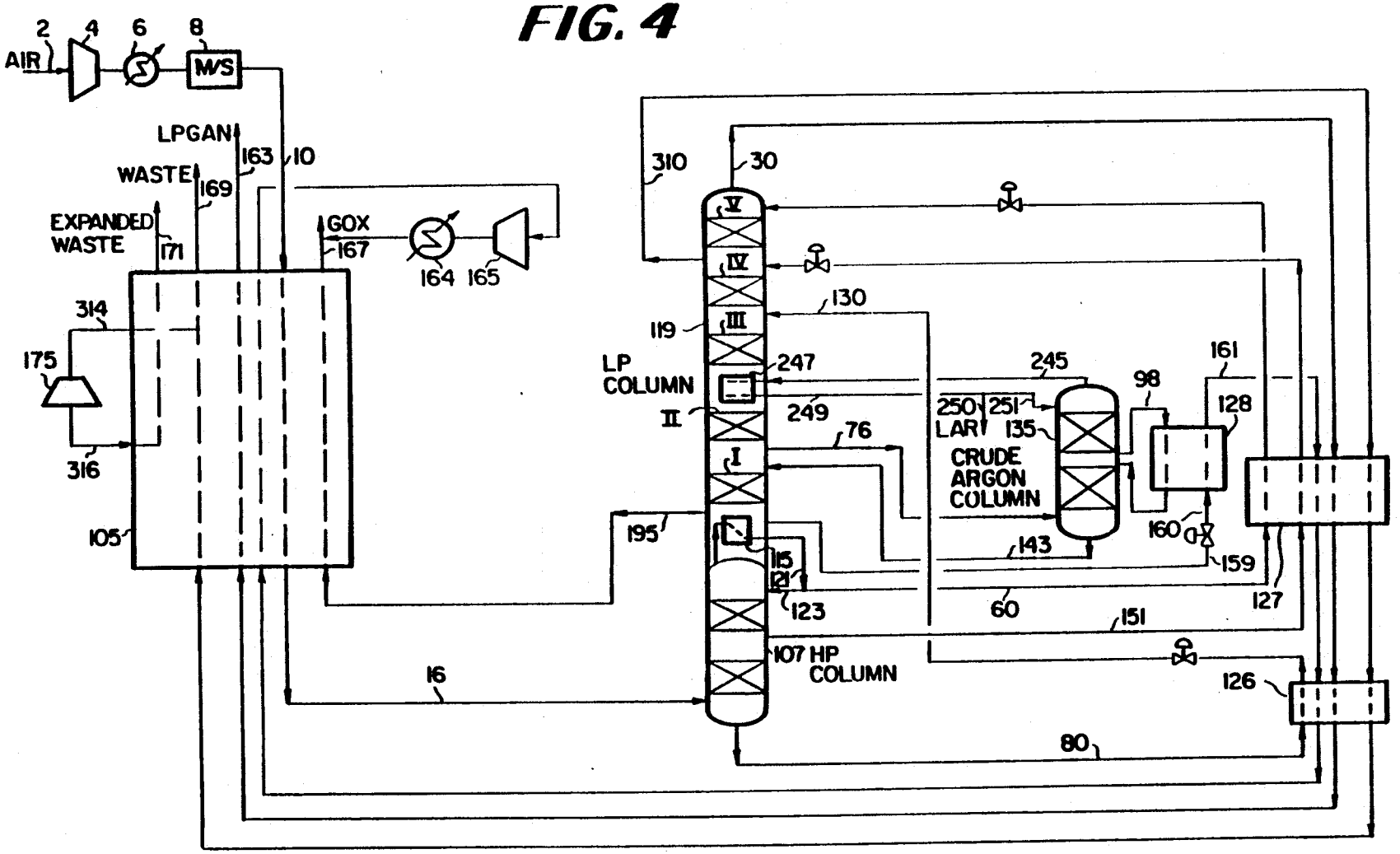
FIG. 4 is a schematic diagram of a variation of the first embodiment of the process of the present invention.

In FIG. 3, one can increase the pressure of stream 160 slightly (thereby saving on compression requirements with respect to compressor 165) by modifying the scheme so that stream 160 is vaporized by condensing a vapor stream from an intermediate location of the crude argon column. FIG. 4 illustrates this modification. Except for incorporation of this modification, the process shown in FIG. 4 is identical to the process shown in FIG. 3 (similar features of the FIG. 4 process utilize common numbering with FIG. 3). Instead of vaporizing stream 160 against the crude argon column overhead stream 96 as shown in FIG. 3, a vapor stream 98 from any intermediate point of the crude argon column is used. The intermediate stream will have a higher temperature than the overhead stream. As a result, a slightly higher pressure liquid oxygen stream 160 can be vaporized.

Figure 5:
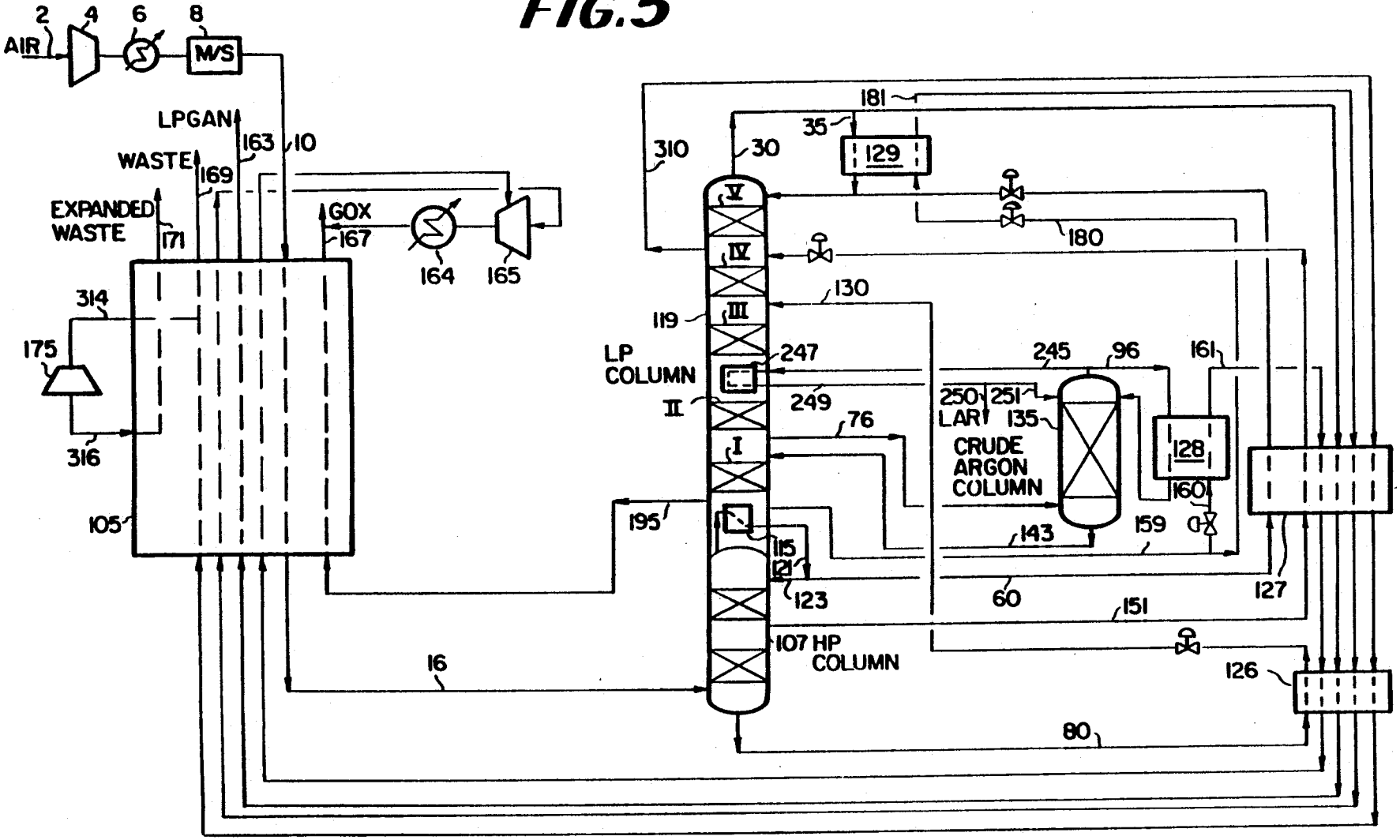
FIG. 5 is a schematic diagram of a second embodiment of the process of the present invention.
Figure 6:
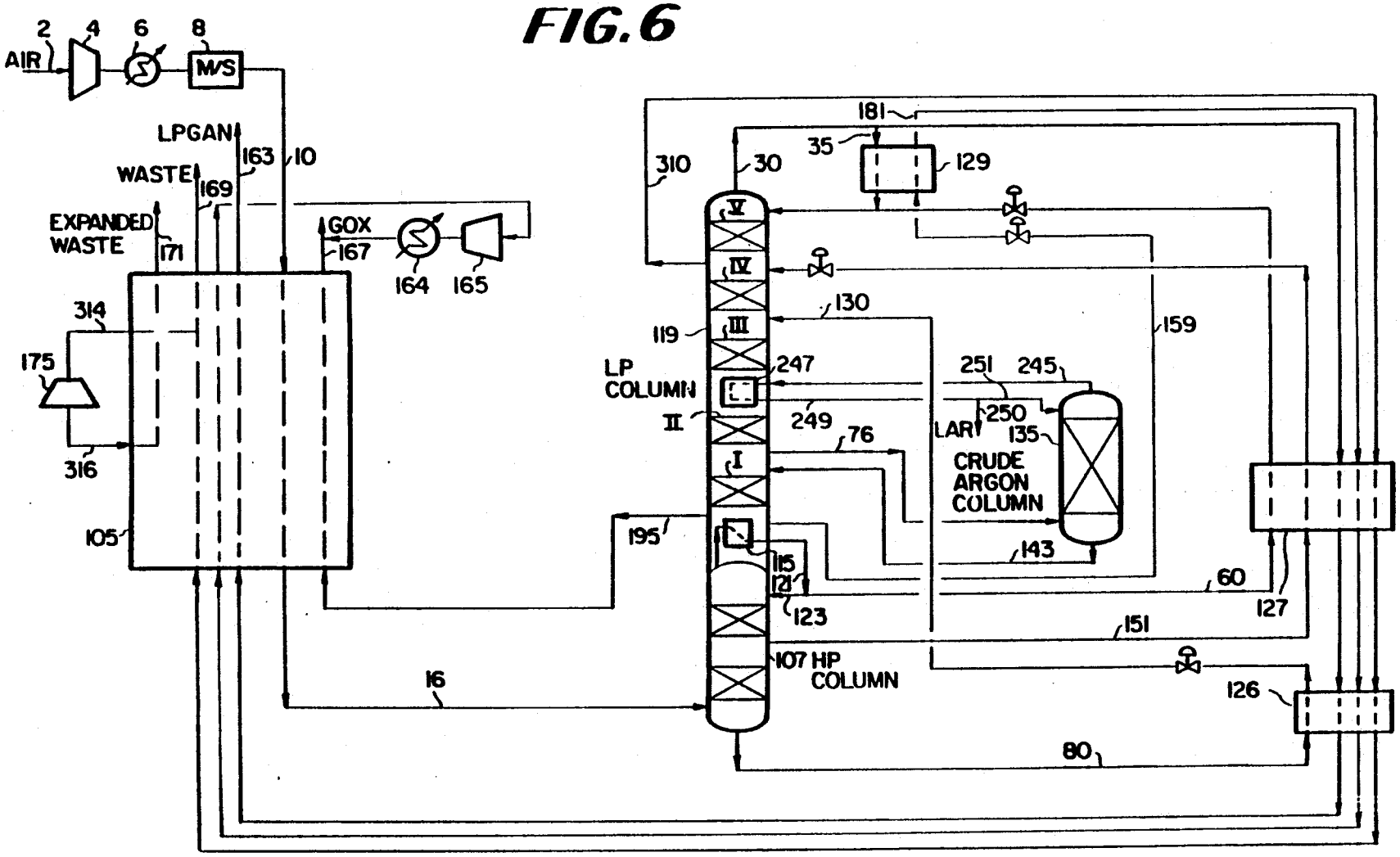
FIG. 6 is a schematic diagram of a variation of the second embodiment of the process of the present invention.

As noted above, the present invention effects a higher argon recovery by allowing optimization of the amount of feed to be sent to the crude argon column. Some argon, however, is still lost at the top of the low pressure column, especially in the nitrogen-rich waste stream. FIG. 5 illustrates one method of reducing this loss. Except for incorporation of this method, the process shown in FIG. 5 is identical to the process shown in FIG. 3 (similar features of the FIG. 5 process utilize common numbering with FIG. 3). One simple way is shown in FIG. 5. In FIG. 5, instead of boiling all of stream 159 against the condensing crude argon column overhead to generate a medium pressure stream 161, a portion of stream 159 (stream 180) is reduced to a lower pressure and boiled in boiler/condenser 129 at the top of the low pressure column against condensing nitrogen stream 35. The condensed nitrogen stream is then sent to the low pressure column as additional reflux to "wash down" the argon to the crude argon column. The low pressure gaseous oxygen produced in boiler/condenser 129 (stream 181) is then warmed in subcoolers 127 and 126 and main exchanger 105 before being compressed along with the medium pressure gaseous oxygen stream in compressor 165. The stream is then combined with stream 167 to form the total gaseous oxygen product stream. In FIG. 5, a stage-wise compression is shown where the low pressure gaseous oxygen stream is compressed to the pressure of the medium pressure gaseous oxygen stream, mixed with the medium pressure gaseous oxygen stream and then boosted to the pressure of the product gaseous oxygen stream. Alternatively, the low pressure gaseous oxygen stream can be compressed in a compander driven by the expander of the cold box and then mixed with the medium pressure gaseous oxygen stream. One extreme of the proposed flowsheet as shown in FIG. 5 is shown in FIG. 6. In this scheme, all the flow of stream 159 is reduced to a low pressure and boiled against condensing nitrogen stream 35 to generate additional reflux for the low pressure column. In FIG. 6, no part of the stream 159 is used to condense crude argon column overhead. The result is that more liquid flow (from the additional reflux for the top of the low pressure column) and more vapor flow (from the increase in duty for the crude argon column condenser) are generated for the top sections of the low pressure column.

Figure 7:
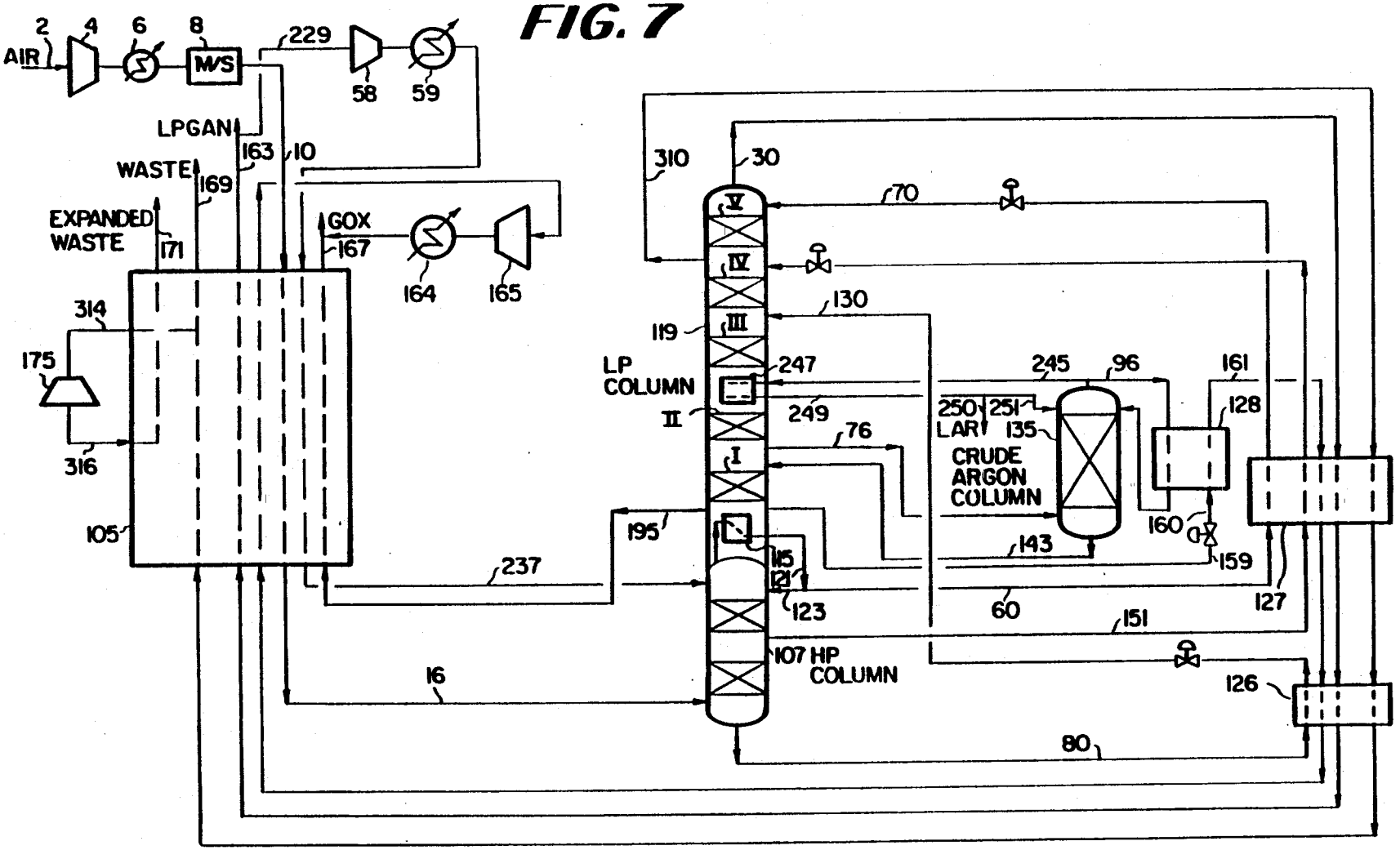
FIG. 7 is a schematic diagram of a third embodiment of the process of the present invention.

Another method of generating more reflux for the low pressure column is to incorporate a heat pump in the distillation system. In FIG. 7, a conventional low pressure nitrogen (LPGAN) heat pump is incorporated with the present invention. Except for incorporation of this LPGAN heat pump, the process shown in FIG. 7 is identical to the process shown in FIG. 3 (similar features of the FIG. 7 process utilize common numbering with FIG. 3). The LPGAN heat pump comprises drawing a portion of the low pressure nitrogen product at the outlet of the main exchanger (stream 229). This stream is compressed in compressor 58 to a pressure slightly higher than that at the top of the high pressure column and cooled against cooling water in cooler 59. The stream is then cooled in main exchanger 105 and fed directly to the top of the high pressure column via stream 237. Stream 237 mixes with the high pressure column overhead stream and is condensed in boiler/condenser 115 to generate more vapor in the low pressure column. The LPGAN heat pump fluid is then removed as a portion of the nitrogen overhead from high pressure column 107, subcooled in subcooler 127, reduced in pressure and subsequently sent to the low pressure column as additional pure reflux via portion of stream 70 prior to beginning a subsequent LPGAN heat pump cycle. It should be noted that this heat pump scheme not only generates additional reflux for the low pressure column to assist in argon separation at the top of the low pressure column, it also generates additional boilup at the bottom section of the low pressure column. Both of these features help to promote enhanced argon recovery.

Comparing the two schemes in FIGS. 5 and 7, in general, the LPGAN heat pump of FIG. 7 has a higher power requirement than the compression of the low pressure gaseous oxygen in FIG. 5. However, as noted earlier, the LPGAN heat pump has the added benefit of generating more boilup at the bottom of the low pressure column.

In FIGS. 3, 4, 5, and 7, liquid oxygen stream 159 is directly sent to reboiler/condenser 128 without any subcooling. Alternatively, this stream (or a portion thereof) could be subcooled in subcooler 127 prior to vaporization in reboiler/condenser 128.

The refrigeration for the flowsheets shown in FIGS. 3 thru 7 is provided by nearly isentropic expansion in an expander of at least a portion of the nitrogen-rich waste stream 310 from the low pressure column. Prior to expansion, the nitrogen-rich waste stream is partially warmed. This means of refrigeration is not an integral part of the invention and any suitable stream can be expanded to provide the needed refrigeration. Several methods of providing refrigeration are already known in the art and can be easily employed with the present invention.

Also, it should be noted that the expansion of the waste stream to generate refrigeration can be integrated with the compression of the gaseous oxygen stream for energy efficiency. A simple compander scheme can be set up where the expansion of the waste stream provides the mechanical work required to compress the oxygen stream. Alternatively, the expansion of the waste stream can be used to generate power to fully or partially offset the power requirement of compressing the oxygen stream.

Figure 8:
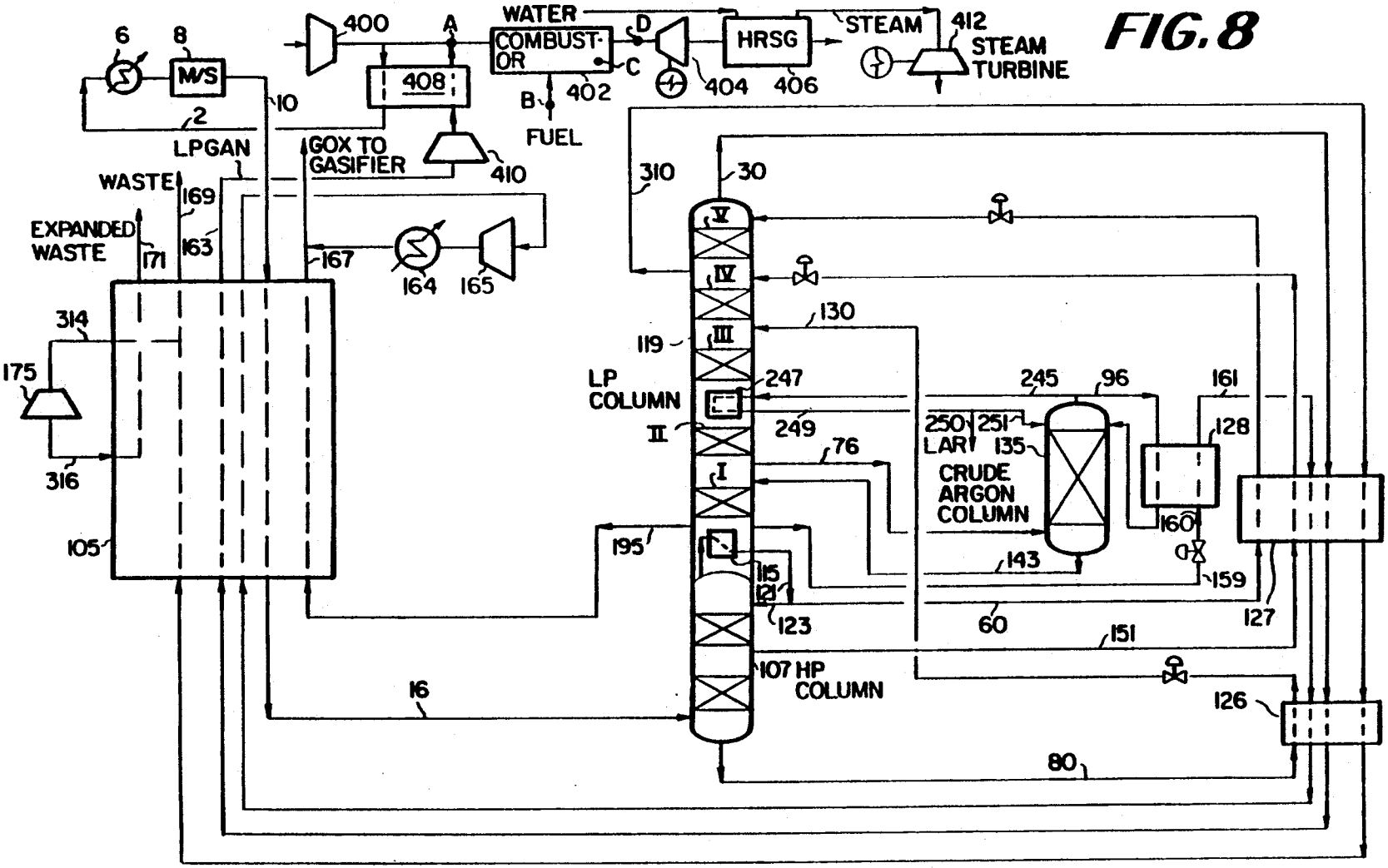
FIG. 8 is a schematic diagram of a fourth embodiment of the process of the present invention.

Finally, it is important to note that the present invention can be efficiently integrated with power generating turbine cycles such as the Coal Gasification Combined Cycle (CGCC) or direct reduction of iron ore processes. In these modes of integration, either all or a portion of feed air for the air separation plant may be withdrawn from the compressor portion of the gas turbine. This air is then cooled against any suitable medium by heat exchange and fed to the air separation unit. All or a portion of the nitrogen from the air separation unit may then be compressed and returned to a suitable location of the gas turbine. Gaseous oxygen is compressed and sent to a coal gasifier to generate fuel gas for the power generation. FIG. 8 shows the process of FIG. 3 integrated with CGCC which CGCC comprises an air compressor 400, a combuster 402, an expander 404, a heat recovery steam generation (HRSG) unit 406, a heat exchanger 408, a nitrogen compressor 410 and a steam turbine 412. The process shown in FIG. 8 is identical to the process shown in FIG. 3 (similar features of the FIG. 8 process utilize common numbering with FIG. 3) except it incorporates the CGCC integration. In FIG. 8, all the feed air 2 to the air separation unit is withdrawn from air compressor 400 of the gas turbine and no supplementary compressor for the air supply is considered. Stream 2 to the air separation unit is cooled by heat exchange in heat exchanger 408 with the returning nitrogen stream 163 which has been compressed in compressor 410. If needed, it can be further cooled by heat exchange against water to make steam or preheat boiler feed water. The pressurized nitrogen stream is utilized by mixing with the air stream such at point A as shown in FIG. 8 or point B to help reduce NOx emission by lowering the flame temperature in the combustor. Also, the required amount of steam sent to the combustor can be reduced. Other possible input locations for the pressurized nitrogen stream are points C and D. The return pressurized nitrogen stream acts as a quench stream to reduce the temperature of the gas entering the expander and provides additional gas volume for power generation.

In order to demonstrate the efficacy of the present invention, the following example is offered.

EXAMPLE

The purpose of this example is to demonstrate the improved argon recovery of the present invention over (1) the prior art as embodied in FIG. 2 and (2) the prior art as taught in U.S. Pat. No. 4,822,395. This was accomplished by performing three computer simulations for the process as depicted in the flowsheet of FIG. 3. In the first simulation, the flow of stream 159 was set at zero, thus in effect simulating the process as depicted in the flowsheet of FIG. 2. (Recall that FIG. 2's flowsheet is the same as FIG. 3's flowsheet except that the stream 159's liquid oxygen draw is absent). Operating conditions for selected streams in the first simulation are included in the following Table 1.

TABLE 1

| Stream Number | Temp. (°F.) | Pressure (psia) | Flow (lb moles/hr) | Composition (mole %) N2 | Ar | O2 |
|---|---|---|---|---|---|---|
| 10 | 45.0 | 152.0 | 100.00 | 78.12 | 0.93 | 20.95 |
| 16 | −254.4 | 150.0 | 100.00 | 78.12 | 0.93 | 20.95 |
| 30 | −303.0 | 40.3 | 64.30 | 99.98 | 0.02 | 0.00 |
| 60 | −272.8 | 145.7 | 33.50 | 100.00 | 0.00 | 0.00 |
| 76 | −275.7 | 45.5 | 35.00 | 0.01 | 8.22 | 91.78 |
| 195 | −274.8 | 46.0 | 20.90 | 0.00 | 0.45 | 99.55 |
| 245 | −281.2 | 44.0 | 36.70 | 0.15 | 99.65 | 0.20 |
| 250 | −281.3 | 44.0 | 0.76 | 0.15 | 99.65 | 0.20 |
| 310 | −302.1 | 41.5 | 13.20 | 99.25 | 0.52 | 0.23 |

In the second simulation, the process of the present invention was simulated by setting the flow of stream 159 at 5% of the feed air flow. Operating conditions for selected streams in this second simulation are included in the following Table 2.

TABLE 2

| Stream Number | Temp. (°F.) | Pressure (psia) | Flow (lb moles/hr) | Composition (mole %) N2 | Ar | O2 |
|---|---|---|---|---|---|---|
| 10 | 45.0 | 152.0 | 100.00 | 78.12 | 0.93 | 20.95 |
| 16 | −254.0 | 150.0 | 100.00 | 78.12 | 0.93 | 20.95 |

TABLE 2-continued

| Stream Number | Temp. (°F.) | Pressure (psia) | Flow (lb moles/hr) | Composition (mole %) N2 | Ar | O2 |
|---|---|---|---|---|---|---|
| 30 | −303.0 | 40.1 | 64.30 | 99.98 | 0.02 | 0.00 |
| 60 | −272.8 | 145.7 | 33.50 | 100.00 | 0.00 | 0.00 |
| 76 | −275.6 | 45.5 | 40.00 | 0.00 | 7.44 | 92.55 |
| 96 | −281.2 | 44.0 | 5.20 | 0.16 | 99.64 | 0.20 |
| 159 | −274.8 | 46.0 | 5.00 | 0.00 | 0.16 | 99.84 |
| 160 | −283.2 | 31.2 | 5.00 | 0.00 | 0.16 | 99.84 |
| 161 | −283.3 | 31.0 | 5.00 | 0.00 | 0.16 | 99.84 |
| 195 | −274.8 | 46.0 | 15.90 | 0.00 | 0.22 | 99.78 |
| 245 | −281.2 | 44.0 | 36.50 | 0.16 | 99.64 | 0.20 |
| 250 | −281.3 | 44.0 | 0.81 | 0.16 | 99.64 | 0.20 |
| 310 | −302.2 | 41.4 | 13.20 | 99.27 | 0.50 | 0.23 |

In the third simulation, the process of U.S. Pat. No. 4,822,395 was simulated by setting the flow of stream 245 to zero and moving the liquid argon product draw (stream 250) to a point after boiler/condenser 128 instead of boiler/condenser 247. In effect, all the condensing duty for the crude argon column is provided by vaporizing only the liquid oxygen from the bottom of the low pressure column (stream 159) which is the teaching of U.S. Pat. No. 4,822,395. Operating conditions for selected streams in this third simulation are included in the following Table 3.

TABLE 3

| Stream Number | Temp. (°F.) | Pressure (psia) | Flow (lb moles/hr) | Composition (mole %) N2 | Ar | O2 |
|---|---|---|---|---|---|---|
| 10 | 45.0 | 152.0 | 100.00 | 78.12 | 0.93 | 20.95 |
| 16 | −252.0 | 150.0 | 100.00 | 78.12 | 0.93 | 20.95 |
| 30 | −302.7 | 40.8 | 64.20 | 99.99 | 0.01 | 0.00 |
| 60 | −272.8 | 145.7 | 33.50 | 100.00 | 0.00 | 0.00 |
| 76 | −277.0 | 45.4 | 20.90 | 0.00 | 26.17 | 73.82 |
| 96 | −281.3 | 44.0 | 21.60 | 0.10 | 99.70 | 0.20 |
| 159 | −274.8 | 46.0 | 20.90 | 0.00 | 0.95 | 99.05 |
| 160 | −283.2 | 31.2 | 20.90 | 0.00 | 0.95 | 99.05 |
| 161 | −283.4 | 30.9 | 20.90 | 0.00 | 0.95 | 99.05 |
| 195 | −274.9 | 46.0 | 0.00 | 0.00 | 0.00 | 0.00 |
| 250 | −281.3 | 44.0 | 0.64 | 0.10 | 99.70 | 0.20 |
| 310 | −301.9 | 42.0 | 13.40 | 99.37 | 0.39 | 0.24 |

To make the argon recovery comparisons between each simulation valid, the following variables were held constant in each simulation:

1) the feed air stream;

2) the product streams (other than the crude liquid argon product in stream 250);

3) the number of theoretical trays used in each column;

4) specifications for the high pressure column and the crude argon column (feed and product locations for the low pressure column were optimized for each simulation).

The following Table 4 shows the results of the three simulations:

TABLE 4

| Simulation Number | Argon Recovery |
|---|---|
| 1 (FIG. 2) | 81 |
| 2 (FIG. 3) | 87 |
| 3 (U.S. Pat. No. 4,822,395) | 69 |

Table 4 shows the significant increase in argon recovery achieved by the present invention as embodied in FIG. 3 over the prior art as embodied in FIG. 2 and over the prior art as embodied in U.S. Pat. No. 4,822,395. This is an unexpected result as follows. Because the method of satisfying the crude argon column condensing duty in FIG. 3 is a hybrid of the thermal linking method in FIG. 2 and the liquid oxygen vaporization method in U.S. Pat. No. 4,822,395, one would except the argon recovery in FIG. 3 to fall between the argon recovery in FIG. 2 and the argon recovery in U.S. Pat. No. 4,822,395. Instead, the argon recovery in FIG. 3 is greater than either the argon recovery in FIG. 2 or the argon recovery in U.S. Pat. No. 4,822,395. It is also interesting to note that by exclusively using the liquid oxygen vaporization method as taught in U.S. Pat. No. 4,822,395, the argon recovery was actually less than the thermal linking method of FIG. 2. The limitation of U.S. Pat. No. 4,822,395, as mentioned previously, is that a very limited feed can be sent to the crude argon column since the crude argon column condensing duty is limited by the amount of liquid oxygen bottoms available in the bottom of the low pressure column.

It is important to note that, as compared to U.S. Pat. No. 4,822,395, not only is more argon recovered by the present invention but less power is consumed as well. The method of Patent '395 produces all the oxygen at a reduced pressure which must then be compressed. However, for the case discussed in the above paragraph, the suggested invention produces only a portion of the oxygen product (specifically, 5% of the feed air flow) at lower pressure while the rest of the oxygen is produced at the higher pressure of the low pressure column pressure. For a final oxygen pressure of 800 psia, the oxygen compression power savings would correspond to about 10.2%.

In summary, the present invention is an efficient and effective method for obtaining higher recoveries of argon in air separation units. The present invention effectively increases the argon recovery by allowing optimization of the amount of feed to be sent to the crude argon column.

The present invention has been described in reference to specific embodiments thereof. These embodiments should not be viewed as limitations of the present invention, the scope of which should be ascertained by the following claims.

We claim:

1. In a cryogenic air distillation process producing argon from feed air using a multiple column distillation system comprising a high pressure column, a low pressure column and a crude argon column wherein a liquid oxygen bottoms is produced in the low pressure column and wherein the crude argon column has a condensing duty, the improvement for increasing argon recovery comprising satisfying a first portion of the crude argon column condensing duty with refrigeration provided from the vaporization of at least a portion of the liquid oxygen bottoms from the low pressure column at reduced pressure and satisfying a second portion of said duty with refrigeration provided from the vaporization of any other process liquid.

2. The process of claim 1 wherein the feed air is compressed, cooled and at least a portion thereof is fed to the high pressure column; wherein in the high pressure column, the compressed, cooled feed air is rectified into a crude liquid oxygen bottoms and a high pressure nitrogen overhead; wherein the crude liquid oxygen is fed to the low pressure column; wherein in the low pressure column, the crude liquid oxygen is distilled into said liquid oxygen bottoms and a gaseous nitrogen overhead; wherein the low pressure column and the high pressure column are thermally linked such that a first portion of the high pressure nitrogen overhead is condensed in a reboiler/condenser against a first portion of vaporizing liquid oxygen bottoms; wherein an argon containing gaseous side stream is removed from a lower intermediate location of the low pressure column and fed to the crude argon column; wherein in the crude argon column, the argon containing gaseous side stream is rectified into an argon-rich vapor overhead and an argon-lean bottoms liquid, which argon-lean bottoms liquid is returned to the low pressure column; and finally wherein at least a portion of the argon-rich vapor overhead is condensed to provide liquid reflux for the crude argon column thereby creating said condensing duty.

3. The process of claim 2 wherein the second portion of the crude argon column duty is satisfied with refrigeration provided from the vaporization of a portion of the crude liquid oxygen bottoms from the high pressure column at reduced pressure.

4. The process of claim 3 wherein the improvement for increasing argon recovery comprising satisfying a portion of the crude argon column condensing duty with refrigeration provided from the vaporization of a portion of the liquid oxygen bottoms from the low pressure column at reduced pressure comprises:

(a) removing a second portion of the liquid oxygen bottoms from the bottom of the low pressure column;

(b) reducing the pressure of the second portion of the liquid oxygen bottoms; and (c) vaporizing the second portion of the liquid oxygen bottoms by heat exchange against a portion of the argon-rich vapor overhead wherein an adequate temperature difference exists between the argon-rich vapor overhead and the second portion of the vaporizing liquid oxygen bottoms, thereby condensing said portion of the argon-rich vapor overhead and returning at least a portion of the condensed argon to the top of the crude argon column to provide a portion of the liquid reflux for the crude argon column.

5. The process of claim 2 wherein the second portion of the crude argon column duty is satisfied with refrigeration provided from the vaporization of at least a portion of liquid descending the low pressure column selected from a location of the low pressure column between the feed point of the crude liquid oxygen from the bottom of the high pressure column and the removal point for the argon containing gaseous side stream for the crude argon column.

6. The process of claim 4 wherein the improvement for increasing argon recovery comprising satisfying a portion of the crude argon column condensing duty with refrigeration provided from the vaporization of a portion of the liquid oxygen bottoms from the low pressure column at reduced pressure comprises:

(a) removing a second portion of the liquid oxygen bottoms from the bottom of the low pressure column;

(b) reducing the pressure of the second portion of the liquid oxygen bottoms; and (c) vaporizing the second portion of the liquid oxygen bottoms by heat exchange against a portion of the argon-rich vapor overhead wherein an adequate temperature difference exists between the argon-rich vapor overhead and the second portion of the vaporizing liquid oxygen bottoms, thereby condensing said portion of the argon-rich vapor overhead and returning at least a portion of the condensed argon to the top of the crude argon column to provide a portion of the liquid reflux for the crude argon column.

7. The process of claim 6 wherein the process further comprises:

(i) removing a third portion of the liquid oxygen bottoms from the bottom of the low pressure column;

(ii) reducing the pressure of the third portion of the liquid oxygen bottoms; and (iii) vaporizing the third portion of the liquid oxygen bottoms by heat exchange against at least a first portion of the gaseous nitrogen overhead wherein an adequate temperature difference exists between the gaseous nitrogen overhead and the third portion of the vaporizing liquid oxygen bottoms, thereby condensing said first portion of the gaseous nitrogen overhead and returning at least a portion of the condensed nitrogen to the top of the low pressure column to provide at least a portion of liquid reflux for the low pressure column.

8. The process of claim 6 wherein the process further comprises using a heat pump cycle to transfer refrigeration from the bottom of the low pressure column to the top of the low pressure column.

9. The process of claim 8 wherein the heat pump cycle comprises:

(A) condensing a second portion of the high pressure nitrogen overhead by heat exchange in the reboiler/condenser against a third portion of vaporizing liquid oxygen bottoms;

(B) reducing the pressure of the second portion of the high pressure nitrogen overhead;

(C) feeding the second portion of the high pressure nitrogen overhead to the top of the low pressure column to provide at least a portion of liquid reflux for the low pressure column;

(D) compressing a first portion of the gaseous nitrogen overhead; and (E) recycling said first portion of the gaseous nitrogen overhead as feed to the top of the high pressure column prior to beginning a susequent heat pump cycle.

10. In a power generating turbine cycle having a nitrogen feed demand and an oxygen feed demand and wherein an air feed is compressed, the process of claim 6 wherein at least a portion of the gaseous nitrogen overhead is used to satisfy the nitrogen feed demand and wherein at least a portion of vaporized liquid oxygen bottoms is used to satisfy the oxygen feed demand.

11. The process of claim 10 wherein the power generating turbine cycle is a coal gasification combined cycle.

12. The process of claim 10 wherein the compression of the air feed in the power generating turbine cycle and the compression of at least a portion of the feed air in the cryogenic air distillation process are performed by the same compressor.

13. The process of claim 10 wherein the compression of the air feed in the power generating turbine cycle and the compression of at least a portion of the feed air in the cryogenic air distillation process are performed independently.

* * * * *